US007538264B1

(12) United States Patent
Turos

(10) Patent No.: US 7,538,264 B1
(45) Date of Patent: May 26, 2009

(54) ERGONOMIC DURABLE DRUMSTICK

(75) Inventor: Kenneth Turos, Las Cruces, NM (US)

(73) Assignee: Sun Systems, Inc., Las Cruces, NM (US)

( * ) Notice: Subject to any disclaimer, the term of this patent is extended or adjusted under 35 U.S.C. 154(b) by 0 days.

(21) Appl. No.: 12/122,320

(22) Filed: May 16, 2008

(51) Int. Cl.
*G10D 13/04* (2006.01)

(52) U.S. Cl. ..... 84/422.4

(58) Field of Classification Search ..... 84/327, 84/329, 421, 422.4
See application file for complete search history.

(56) References Cited

U.S. PATENT DOCUMENTS 4,488,470 A 12/1984 Larrain
4,570,527 A 2/1986 Pruitt
4,763,557 A * 8/1988 Donohoe ..... 84/422.4
5,170,001 A 12/1992 Amendola
5,503,056 A 4/1996 Evans
5,503,057 A 4/1996 Smith, Jr.
6,028,260 A * 2/2000 LaLonde ..... 84/422.4
6,028,261 A 2/2000 Johnson
7,084,339 B2 8/2006 Rundle
2006/0027073 A1 * 2/2006 Richard ..... 84/422.4

* cited by examiner

*Primary Examiner*—Kimberly R Lockett
(74) *Attorney, Agent, or Firm*—Ray R. Regan

(57) ABSTRACT

The specification and drawing figures describe and show an ergonomic durable drumstick that includes a percussion member from which a tubular body extends. The percussion member includes a plug having annular rings protruding from the outer surface of the plug on which a drumhead contact tip is attached. One end of a hollow cylindrical tube having a sleeve or color coating is connected to the percussion member. The other end of the hollow cylindrical tube is attached to a neck. Spacers are mountable on the tubular body and neck. Mufflers are inserted into the tubular body and neck.

15 Claims, 2 Drawing Sheets

ERGONOMIC DURABLE DRUMSTICK

FIELD OF TECHNOLOGY

The apparatus and method disclosed, illustrated and claimed in this document pertain generally to percussion instruments, specifically an apparatus for playing a drum. More particularly, the new and useful ergonomic durable drumstick of this document provides a drumstick that is durable, is efficiently held by a musician, and is visually distinctive and appealing by providing a range of color aesthetics.

BACKGROUND

Apparatus for percussively striking the head of a drum or other instruments (such as triangles, cymbals, and bells), commonly known as drumsticks, traditionally have been made of wood. More recently, some drumsticks have been fashioned of metal, plastics, and/or combinations of alternative materials. Little thought or design effort has been made in connection with improving the tympanic sound of a drumstick, its ergonomic handling, its durability, or visual aesthetics.

Wood, however, is not durable when shaped into a drumstick wielded by a musician intent on beating a drum as rapidly or as loudly as possible. Wood drumsticks break frequently during use. Efforts to make drumsticks from metal, plastics or other materials generally result in a drumstick that produces an unacceptable sound. Drumsticks made of material other than wood are often difficult to hold. While playing, a musician's fingers and palms may become sweaty, and drumsticks made of material other than wood slip from a musician's grip, or rotate unexpectedly. In the past, the different "feel" of drumsticks made of material other than wood has caused a musician to render music differently. And it is common knowledge that a wood drumstick, generally tan in color, is not an instrument that attracts attention or even interest among observers.

Accordingly, a need exists in the music industry for a new, useful, and improved ergonomic durable drumstick that is capable of indefinite use, rendering a pure sound, easily held during use, and is attractive not only to the musician, but to observers.

SUMMARY

The apparatus and method disclosed, illustrated and claimed in this document address the above-stated needs by providing a drumstick that includes a percussion member. A tubular body extends from one end of the percussion member. The tubular body is formed with a chamber. The percussion member includes a plug. The plug extends from the other end of the percussion member. A plurality of annular rings protrudes from the outer surface of the cylindrical plug. In addition, the plug includes a conical leading end. The conical leading end is designed to engage a drumhead contact tip. Accordingly, the drumhead contact tip is formed with a hollow bore into which the conical leading end may be inserted to fixedly engage the drumhead contact tip. In addition, a hollow cylindrical tube is provided. One end of the hollow cylindrical tube is connected to the tubular body. The other end of the hollow cylindrical tube is connected to a neck. A plurality of spacers is provided for engagement with the tubular body and with the neck. In addition, one or more mufflers are provided. The mufflers are insertable into opposing ends of the hollow cylindrical tube.

It will become apparent to one skilled in the art that the claimed subject matter as a whole, including the structure of the apparatus, and the cooperation of the elements of the apparatus, combine to result in a number of unexpected advantages and utilities. The structure and co-operation of structure of the ergonomic durable drumstick will become apparent to those skilled in the art when read in conjunction with the following description, drawing figures, and appended claims.

The foregoing has outlined broadly the more important features of the invention to better understand the detailed description that follows, and to better understand the contributions to the art. The ergonomic durable drumstick is not limited in application to the details of construction, and to the arrangements of the components, provided in the following description or drawing figures, but is capable of other embodiments, and of being practiced and carried out in various ways. The phraseology and terminology employed in this disclosure are for purpose of description, and therefore should not be regarded as limiting. As those skilled in the art will appreciate, the conception on which this disclosure is based readily may be used as a basis for designing other structures, methods, and systems. The claims, therefore, include equivalent constructions. Further, the abstract associated with this disclosure is intended neither to define the ergonomic durable drumstick, which is measured by the claims, nor intended to limit the scope of the claims. The novel features of the ergonomic durable drumstick are best understood from the accompanying drawing, considered in connection with the accompanying description of the drawing, in which similar reference characters refer to similar parts, and in which:

Figure 1:
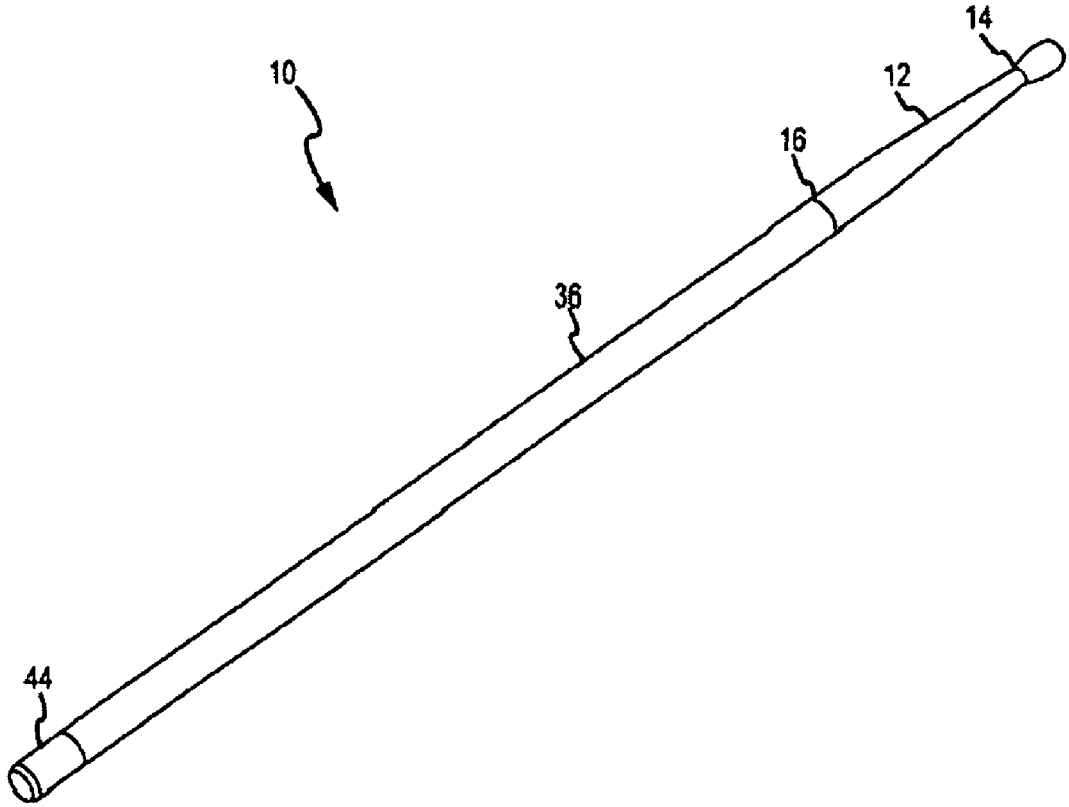
FIG. 1 of the drawing is a perspective view of the ergonomic durable drumstick following assembly of the component parts.

To the extent that the numerical designations in the drawing figures include lower case letters such as "a,b" such designations include multiple references, and the letter "n" in lower case such as "a-n" is intended to express a number of repetitions of the element designated by that numerical reference and subscripts.

DETAILED DESCRIPTION

Definitions

The term "sleeve dimpling" as used in this document means the tendency of the sleeve to rise above the exposed surface of hollow cylindrical tube, or ripple, when the components of the drumstick are fitted together by compression.

The term "first muffler" and "second muffler" mean a substantially solid cylindrical column made of rubber, foam, or similar materials that not only eliminate a tinny sound when the assembled drumstick strikes a drumhead, but also absorbs tympanic harmonics transmitted from the drumhead to the hands, wrists and muscles of the user of the drumstick.

The term "tympanic harmonics" means harmonics transmitted from the drumhead to the hands, wrists and muscles of the user of the drumstick in operation of the drumstick.

The term "color aesthetics" means that a wide range of colors and patinas that are possible by applying varying metal finishing treatments during manufacture, and due to applying sleeves having a wide assortment of colors.

As used in this document the term "exemplary" means serving as an example, instance, or illustration; any aspect described in this document as "exemplary" is not intended to mean preferred or advantageous over other aspects of the ergonomic durable drumstick.

Description

Figure 2:
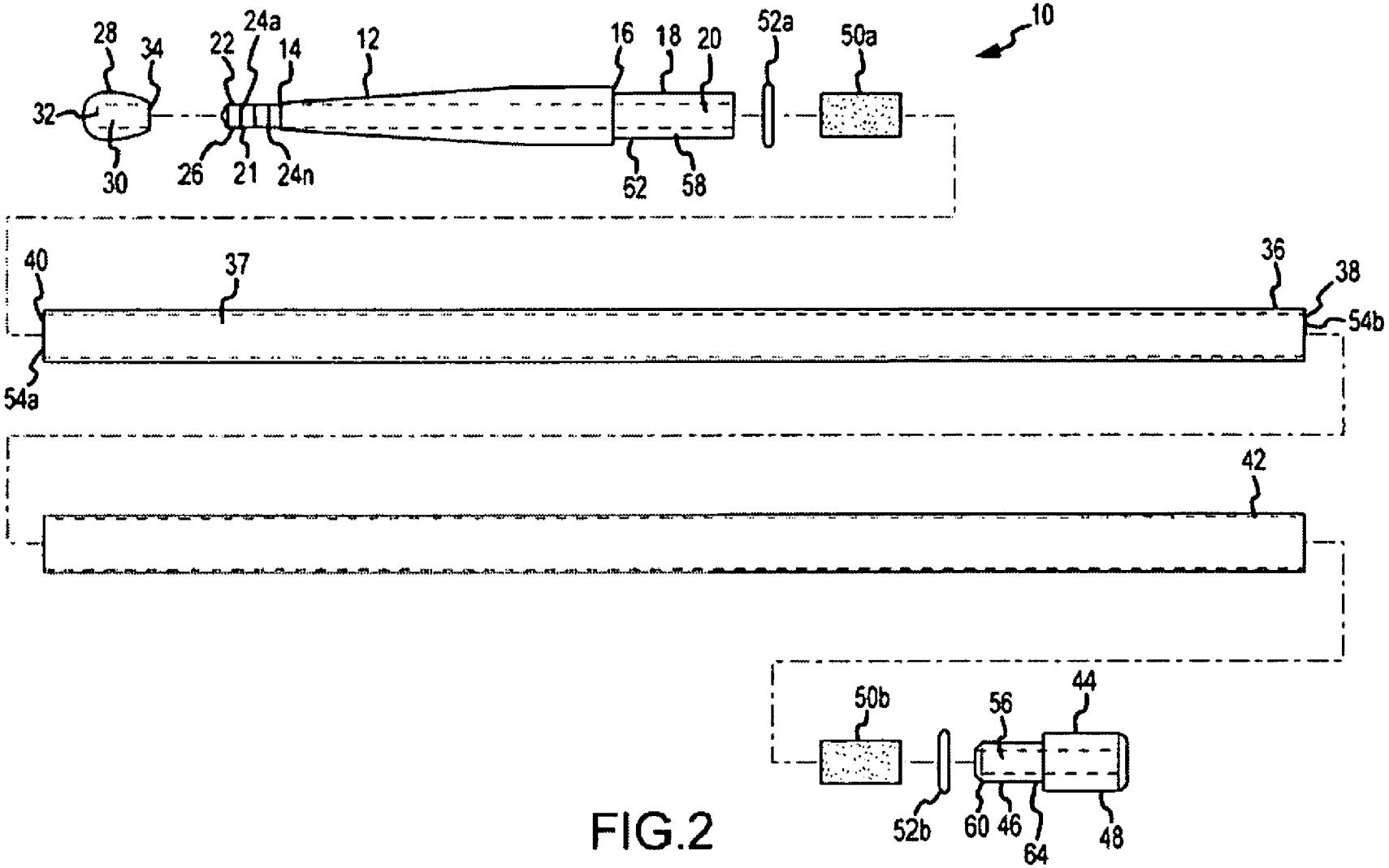
FIG. 2 is side exploded view illustrating the ergonomic durable drumstick.

As illustrated in FIGS. 1-2, an ergonomic durable drumstick is provided that in its broadest context includes a percussion member. A tubular body extends from one end of the percussion member. The tubular body is formed with a chamber. The percussion member includes a plug. The plug extends from the other end of the percussion member. A plurality of annular rings protrudes from the outer surface of the cylindrical plug. In addition, the plug includes a conical leading end. The conical leading end is designed to engage a drumhead contact tip. Accordingly, the drumhead contact tip is formed with a hollow bore into which the conical leading end is insertable to fixedly engage the drumhead contact tip. In addition, a hollow cylindrical tube is provided. One end of the hollow cylindrical tube is connected to the tubular body. The other end of the hollow cylindrical tube is connected to a neck. A plurality of spacers is provided for engagement with the tubular body and with the neck. In addition, one or more mufflers are provided. The mufflers are insertable into opposing ends of the hollow cylindrical tube. In combination, the components of the ergonomic durable drumstick provide an exemplary means for playing a drum.

More specifically, an ergonomic durable drumstick 10 includes a tapered substantially hollow percussion member 12. The tapered substantially hollow percussion member 12 is formed with a distal end 14 and a proximal end 16. The tapered substantially hollow percussion member 12 also includes a tubular body 18. As illustrated in FIG. 2, the tubular body 18 is formed with a chamber 20. In one aspect of the ergonomic durable drumstick 10, the tubular body 18 extends monolithically from the proximal end 16 of the tapered substantially hollow percussion member 12. As illustrated in FIG. 2, the tubular body 18 has a circumference that is less than the circumference of the proximal end 16 of the tapered substantially hollow percussion member 12.

The ergonomic durable drumstick 10 also includes a plug 21. The plug 21 has a circular cross-section. The plug 21 is formed with conical leading end 22. In one aspect of the ergonomic durable drumstick 10, the conical leading end 22 monolithically extends from the distal end 14 of the tapered substantially hollow percussion member 12. As also illustrated in FIG. 2, the plug 21 includes a plurality of annular rings 24*a-n*. The plurality of annular rings 24*a-n* protrudes from the outer surface 26 of the plug 21 between the conical leading end 22 and the distal end 14 of the percussion member 12. In operation, the conical leading end 22 provides the mechanical advantage of fixedly engaging the percussion member 12 with a drumhead contact tip 28 that is also included in the ergonomic durable drumstick 10. Thus, as illustrated by cross reference between FIGS. 1 and 2, the drumhead contact tip 28 is formed with a hollow bore 30. The hollow bore 30 has a closed end 32 and an open end 34. The open end 34 is adapted to receive the plug 21. In addition, the closed end 32 of the drumhead contact tip 28 provides a surface into which the conical leading end 22 of the percussion member 12 may be driven by compression to ensure that the drumhead contact tip 28 is fixedly connected to the tapered substantially hollow percussion member 12.

The ergonomic durable drumstick 10 also includes a hollow cylindrical tube 36 best illustrated by cross-reference between FIGS. 1 and 2. The hollow cylindrical tube 36 has an aft end 38 and a fore end 40. As illustrated, the fore end 40 is fixedly connectable to the tubular body 18. A sleeve 42 is surroundingly formed on and around the hollow cylindrical tube 36. In one aspect of the ergonomic durable drumstick 10, the sleeve 42 is formed from a polyolefin material. As a person skilled in the art will appreciate, a polyolefin material is a polymer produced from olefin, also called an alkene, as a monomer. In general, polyethylene is a polyolefin produced by polymerizing the olefin ethylene. Although polyolefin has proven advantageous in forming the sleeve on the hollow cylindrical tube, the use of polyolefin is not a limitation of the disclosure and claims of this document, and other materials may be used to achieve the mechanical and visual advantages and benefits of the ergonomic durable drumstick 10. The sleeve 42 surroundingly formed on the hollow cylindrical tube 36 provides at least two mechanical and aesthetic advantages. The sleeve provides a grippable surface for a musician to hold and manipulate the ergonomic durable drumstick 10. In addition, the sleeve 42 is provided in a wide range of colors and patinas, thus providing color aesthetics desired by musicians. The length of the hollow cylindrical tube 36 along the longitudinal axis of the hollow cylindrical tube 36 is substantially equal to the length of the sleeve 42 formed on the hollow cylindrical tube 36 so as to provide the mechanical advantage of avoiding unraveling of the sleeve following compressive assembly of the drumstick 10.

As also illustrated by cross-reference between FIGS. 1 and 2, a substantially hollow neck 44 is provided. The substantially hollow neck 44 includes a first member 46 that is attached to a second member 48. The circumference of the first member 46 is less than the circumference of the second member 48, providing the mechanical advantage described below in connection with the use of spacers.

A plurality of mufflers 50*a,b* and a plurality of spacers 52*a,b* is provided. As illustrated best in FIG. 2, a first muffler 50*a* and a second muffler 50*b* are insertable into opposing ends 54*a,b* of the hollow cylindrical tube 36. A portion of the first muffler 50*a* and of the second muffler 50*b* is also insertable, respectably, into chamber 20 of the tubular body 18. Similarly, the second muffler 50*b* is insertable into the other opposing end 54*b* of the hollow cylindrical tube 36. A portion of the second muffler 50*b* is also insertable into a hollow duct 56 of the first member 46 of the neck 44.

As indicated, a plurality of spacers 52*a,b* is provided. A first spacer 52*a*, as illustrated in FIG. 2, is slidably engageable with the exterior surface 58 of the tubular body 18. In addition, a second spacer 52*b* is slidably engageable on the outside surface 60 of the first member 46 of the hollow neck 44. The mechanical advantage of the use of the first spacer 52*a* and the second spacer 52*b* is to eliminate sleeve dimpling as described in this document. Thus, when the fore end 40 of the hollow cylindrical tube 36 is compressed against the first muffler 50*a* mounted on the tubular body 18, and is secured against the exposed face 62 of the proximal end 16 of the percussion member 12, sleeve dimpling in the area adjacent the fore end 40 of the hollow cylindrical tube 36 on which a sleeve 42 is surroundingly formed is eliminated. Likewise, when a second spacer 52*b* is slidably engaged with the first member 46 of the neck 44, and the aft end 54*b* of the hollow cylindrical tube 36 is compressed against the spacer 52*b* that is likewise adjacent the face 64 of the second member 48 of the neck 44, sleeve dimpling in the area adjacent the aft end 38 of the hollow cylindrical tube 36 is also eliminated.

As will be evident to a person of skill in the art, a variety of materials may be used to make and assemble the ergonomic durable drumstick 10. For example, in one aspect of the ergonomic durable drumstick 10, the drumhead contact tip 28 preferably is made of nylon. However, the use of nylon is not a limitation of the ergonomic durable drumstick 10. Nylon has proven satisfactory, however, in replicating the traditional and desired sound of a drum beaten by a drumstick having the drumhead contact tip 28. Likewise the first muffler 50*a* and the second muffler 50*b* may be made of rubber, or, in the alternative, and in another aspect, may be made of foam. As evident, however, to a person skilled in the art, the use of rubber or foam is not limitations of the ergonomic durable drumstick 10.

Claim elements and steps in this document have been numbered solely as an aid in understanding the description. The numbering is not intended to, and should not be considered as intending to, indicate the ordering of elements and steps in the claims. In addition, the ergonomic durable drumstick 10 illustrated in drawing FIGS. 1 through 2 shows at least one aspect of the ergonomic durable drumstick that is not intended to be exclusive, but merely illustrative of the disclosed embodiment. As a person skilled in the art will appreciate, method steps may be interchanged sequentially without departing from the scope of the ergonomic durable drumstick. In addition, means-plus-function clauses in the claims are intended to cover the structures described as performing the recited function that includes not only structural equivalents, but also equivalent structures. Likewise, although the apparatus and methods provide for use with currently known materials and technologies, the materials and technologies are not limitations of future uses or methods of making the ergonomic durable drumstick; rather, it is expected that such materials and technologies will change over time.

What is claimed is:

1. An ergonomic durable drumstick, comprising:

a tapered substantially hollow percussion member having a distal end and a proximal end, further comprising a tubular body formed with a chamber monolithically extending from the proximal end having a circumference less than the circumference of the proximal end of the tapered substantially hollow percussion member;

a plug having a circular cross-section formed with a conical leading end monolithically extending from the distal end of the tapered substantially hollow percussion member, wherein the plug includes a plurality of annular rings protruding from the outer surface of the plug between the conical leading end and the distal end of the percussion member adapted to fixedly engage a drumhead contact tip;

a drumhead contact tip formed with a hollow bore having a closed end and an open end adapted to receive the plug;

a first spacer slidably engageable with the exterior surface of the tubular body adapted to preclude sleeve dimpling;

a hollow cylindrical tube having an aft end and a fore end, the fore end fixedly connectable to the tubular body;

a sleeve surroundingly formed around the hollow cylindrical tube;

a first muffler and a second muffler, wherein the second muffler is insertable into one of the opposing ends of the hollow cylindrical tube adapted to absorb tympanic harmonics;

a substantially hollow neck insertable into the aft end of the hollow cylindrical tube, wherein the substantially hollow neck includes a first member attached to a second member wherein the circumference of the first member is less than the circumference of the second member; and a second spacer slidably engageable on the outside surface of the first member of the partially hollow neck adapted to avoid sleeve dimpling.

2. An ergonomic durable drumstick as recited in claim 1, wherein the sleeve is formed of a material attached to the exposed surface of the hollow cylindrical tube.

3. An ergonomic durable drumstick as recited in claim 2, wherein the sleeve is formed of a polyolefin material heat shrinked onto the exposed surface of the hollow cylindrical tube.

4. An ergonomic durable drumstick as recited in claim 1, wherein the drumhead contact tip is made of nylon.

5. An ergonomic durable drumstick as recited in claim 1, wherein the first muffler and second muffler are made of rubber.

6. An ergonomic durable drumstick as recited in claim 1, wherein the first muffler and second muffler are made of foam.

7. An ergonomic durable drumstick as recited in claim 1 wherein the conical leading end of the cylindrical plug is adapted to fixedly engage and extend a distance into the closed end of the bore of the beveled nylon drumhead contact tip to fixedly attach the cylindrical plug to the drumhead contact tip.

8. An ergonomic durable drumstick as recited in claim 1, wherein the length of the hollow cylindrical tube along the longitudinal axis of the hollow cylindrical tube is substantially equal to the length of the sleeve formed over the hollow cylindrical tube to avoid unraveling of the sleeve following compressive assembly of the drumstick.

9. A method of making a drumstick, comprising:

selecting a plurality of materials for forming components of the drumstick selected from the group of materials consisting of metal, rubber, foam, nylon and plastic;

manipulating the metal material to form a percussion member having a partially tapered hollow cylindrical body;

attaching to one end of the percussion member a tubular metal body formed with a chamber;

attaching to the opposing end of the percussion member a solid metal plug formed with a circular cross-section;

connecting to the solid metal plug a material for forming a contact tip for contact with a drumhead;

forming a hollow metal cylindrical tube engageable with the tubular metal body formed with a chamber;

powder coating the exterior visible surface of the hollow cylindrical tube with one or more colors;

making a first muffler and a second muffler from one or more of the materials adapted for insertion into opposing ends of the hollow metal cylindrical tube;

inserting a neck into one end of the hollow metal cylindrical metal tube;

providing a plurality of spacers engageable with the exterior surface of the tubular metal body and outside surface of the partially hollow neck; and applying compression to the components of the drumstick to assemble the drumstick.

10. A method of making an unbreakable drumstick as recited in claim 9, wherein the step of attaching to the opposing end of the percussion member a solid metal plug includes the substep of extending a conical leading end from one end of the solid metal plug.

11. A method of making an unbreakable drumstick as recited in claim 10, wherein the step of attaching to the opposing end of the percussion member a solid metal plug includes the substep of forming one or more rings protruding from the outer surface of the solid metal plug.

12. A method of making an unbreakable drumstick as recited in claim 11, wherein the step of attaching to the solid metal plug a material for forming a contact tip for contact with a drumhead includes the substep of beveling the material to form the contact tip.

13. A method of making an unbreakable drumstick as recited in claim 12, wherein the step of attaching to solid metal plug a material for forming a contact tip for contact with a drumhead includes the substep of selecting the material from nylon.

14. A method of making an unbreakable drumstick as recited in claim 13, wherein the step of attaching to solid metal plug a material for forming a contact tip for contact with a drumhead includes the substep of forming in the contact tip a hollow bore formed with a closed end and an open end.

15. A method of making an unbreakable drumstick as recited in claim 14, wherein the step of inserting a neck into one end of the hollow metal cylindrical tube includes the substep of forming the neck of a first member and a second member wherein the circumference of the first member is less than the circumference of the second member.

* * * * *